US007012628B2

(12) United States Patent
Masuda

(10) Patent No.: US 7,012,628 B2
(45) Date of Patent: Mar. 14, 2006

(54) IMAGE FORMING METHOD

(75) Inventor: Yoshihisa Masuda, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 514 days.

(21) Appl. No.: 10/364,463

(22) Filed: Feb. 12, 2003

(65) Prior Publication Data

US 2004/0155949 A1 Aug. 12, 2004

(51) Int. Cl.
*G03G 15/00* (2006.01)

(52) U.S. Cl. ..... 347/116; 347/232; 399/301

(58) Field of Classification Search ..... 347/116, 347/232; 399/301
See application file for complete search history.

(56) References Cited

U.S. PATENT DOCUMENTS 6,278,857 B1 * 8/2001 Monji et al. ..... 399/301
6,360,070 B1 * 3/2002 Taka et al. ..... 399/301

FOREIGN PATENT DOCUMENTS

JP 10-339984 A 12/1998
JP 11-119502 A 4/1999
JP 2000-284569 A 10/2000

* cited by examiner

*Primary Examiner*—Huan Tran
(74) *Attorney, Agent, or Firm*—Foley & Lardner LLP

(57) ABSTRACT

A printer CPU controls rotations of a photosensitive drum for black and photosensitive drums for other colors such that a phase angle difference between the photosensitive drum for black and the photosensitive drums for the other colors during image formation in a color mode is unchanged before and after execution of a black mode.

13 Claims, 4 Drawing Sheets

IMAGE FORMING METHOD

BACKGROUND OF THE INVENTION

The present invention relates to an image forming method for controlling the rotations of photosensitive drums in both a black mode and a color mode in a tandem-drum type color image forming apparatus.

Prior-art techniques, as described below, are disclosed as regards a rotation control of a plurality of photosensitive drums in a tandem-drum type color image forming apparatus.

Jpn. Pat. Appln. KOKAI Publication No. 2000-284569 discloses an image forming apparatus wherein a set of registration patterns of respective colors are formed on a transfer belt by repeating them twice or more within a time period that is not less than a cycle of the drum and is less than a circulation cycle of the transfer belt. The registration patterns are detected, and information on the amount of a color registration error, or a color misregistration, of the respective colors of each set is acquired. A color registration error component of the drum rotation cycle and a component of the transfer belt circulation cycle are extracted from the acquired information, and the timing of writing of each scan line on the drum is corrected so as to eliminate a color misregistration on the basis of the extracted components.

This image forming apparatus includes phase detection means for detecting a variation in rotational phase of the respective drums. When this means detects a rotational phase difference, a registration pattern corresponding to the length of one cycle of the drum is formed, and the data on the color registration error component of the drum rotation cycle is updated.

Jpn. Pat. Appln. KOKAI Publication No. 11-119502 discloses an image forming apparatus having a plurality of drums and a single drive means for rotating the drums, wherein the rotations of the drums are synchronized by a rigid coupling member that couples each drum and the drive means.

Jpn. Pat. Appln. KOKAI Publication No. 10-339984 discloses a tandem-type image forming apparatus wherein a convey belt is driven by a drive roller, and while drums are driven by the convey belt, an image formed on each drum is successively transferred onto a transfer medium.

In this image forming apparatus, the peripheral speed of the drum and the peripheral speed of the convey belt are measured, and the convey belt peripheral speed is subtracted from the measured drum peripheral speed to calculate a correction drum peripheral speed. Based on the calculated correction drum peripheral speed, the scan operation of image write means is controlled so as to correct a registration error of the image write position due to a variation in the drum peripheral speed.

The problems with these image forming apparatuses will now be discussed.

In Jpn. Pat. Appln. KOKAI Publication No. 2000-284569, a rotational phase difference is always detected after a mode, such as a black mode, in which the transfer belt and only a specified drum are rotated. In each of such cases, a registration pattern corresponding to the length of one cycle of the drum needs to be formed and the data on the color registration error component of the drum rotation cycle has to be updated. Consequently, when an image including a black mode component is output, the productivity considerably deteriorates (the time needed up to completion of output increases). Moreover, the life of drums, developer, etc. becomes shorter.

In Jpn. Pat. Appln. KOKAI Publication No. 11-119502, the drums are coupled by the rigid coupling member and synchronized. Thus, it is not possible to output an image by rotating only a specified drum as in a black mode. Even when an image including only a black page is to be output, all the drums and developing devices are rotated and the life of the drums for color images and developing devices decreases.

Jpn. Pat. Appln. KOKAI Publication No. 10-339984, sensors need to be provided for measuring the peripheral speeds of the drums and belt drive roller. In addition, a memory area for storing calculated correction drum peripheral speed, as well as complex arithmetic operations, is required. Further, before and after a mode, like a black mode, in which the transfer belt and only a specified drum are rotated, the phase of drums, which have been at rest, and the phase of the transfer belt are displaced. In each of such cases, the correction drum peripheral speed has to be calculated. As a result, when an image including a black mode component is output, the productivity considerably deteriorates (the time needed up to completion of output increases). Moreover, the life of drums, developer, etc. becomes shorter.

As has been described above, before and after the black mode (in which only the black drum rotates and the other color drums are set at rest), the phase angle difference between the black drum and the other color drums alters depending on the time of rotation of the black drum in the black mode. Hence, such a problem arises that a color registration error varies (deteriorates) before and after the black mode.

BRIEF SUMMARY OF THE INVENTION

The object of the present invention is to provide an image forming method capable of preventing a variation in phase angle difference between a black drum and other color drums in a tandem-drum type color image forming apparatus before and after execution of a black mode (only a black photosensitive drum rotates), thereby always maintaining a state in which a color registration error is small.

In order to achieve the object, the present invention may provide an image forming method that forms an image using a photosensitive drum for black and photosensitive drums for colors other than black, on which electrostatic latent images are formed, wherein there are provided a black mode in which only the photosensitive drum for black is rotated and a color mode in which all the photosensitive drums are rotated, and rotations of the photosensitive drum for black and the photosensitive drums for the other colors are controlled such that a phase angle difference between the photosensitive drum for black and the photosensitive drums for the other colors after image formation in the color mode is unchanged before and after execution of the black mode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
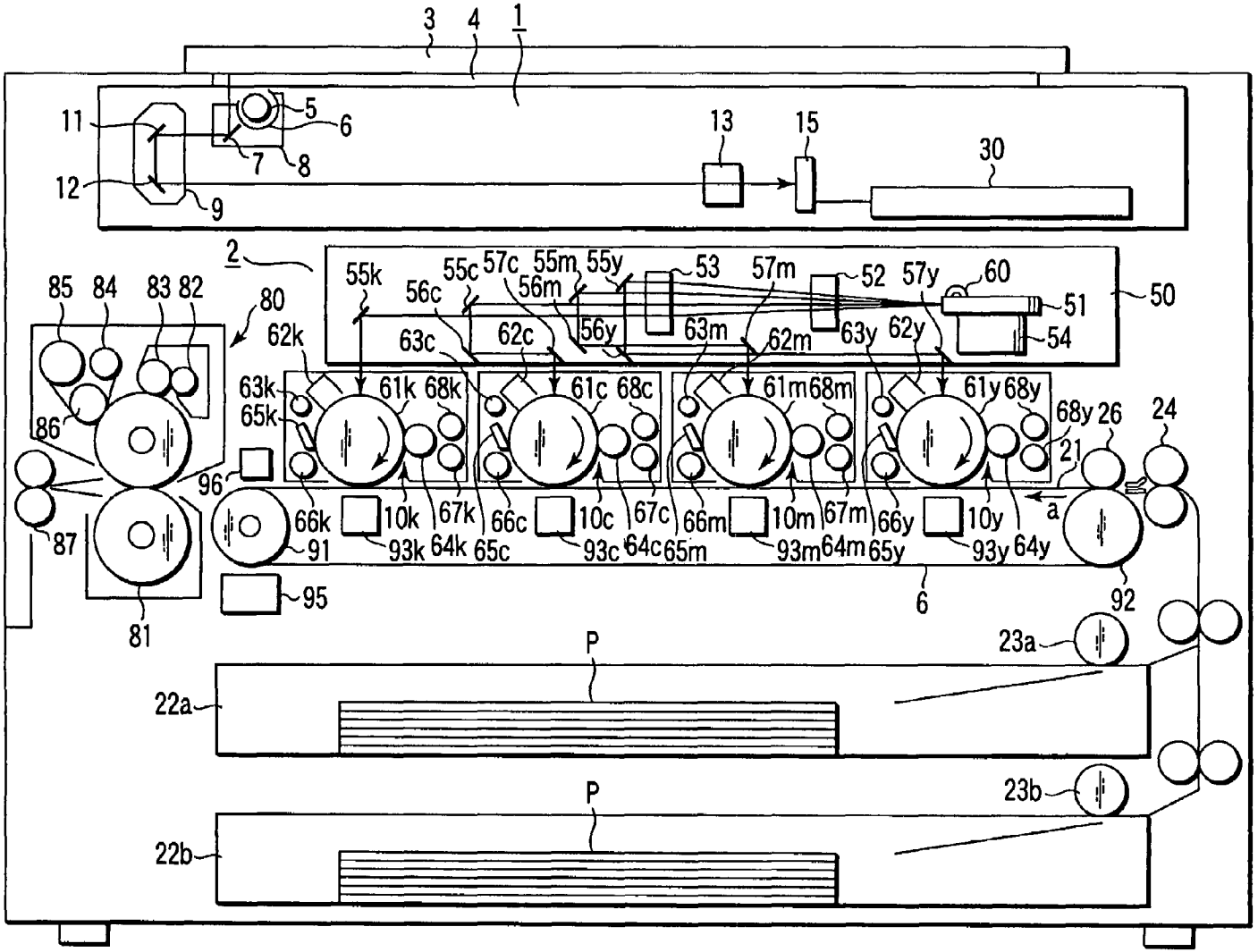
FIG. 1 is a cross-sectional view showing an internal structure of a tandem-drum type color image forming apparatus according to an image forming method of the present invention.

FIG. 1 schematically shows an internal structure of a tandem-drum type color image forming apparatus according to an image forming apparatus of the present invention.

In general terms, the color image forming apparatus comprises a color scanner section 1 serving as image reading means for reading a color image on an original, and a color printer section 2 serving as image forming means for forming a copy image of the read color image.

The color scanner section 1 has an original table cover 3 on its upper part, and an original table 4 formed of transparent glass and disposed to face the original table cover 3 in the closed state. An original is placed on the original table 4. Below the original table 4, there are provided an exposure lamp 5 for illuminating the original placed on the original table 4; a reflector 6 for converging light from the exposure lamp 5 onto the original; and a first mirror 7 for deflecting the reflection light from the original to the left in the Figure. The exposure lamp 5, reflector 6 and first mirror 7 are fixed to a first carriage 8. The first carriage 8 is driven by a pulse motor (not shown) by means of a toothed belt (not shown), etc. so that the first carriage 8 may be moved in parallel along the lower surface of the original table 4.

A second carriage 9 is disposed on the left side (in the Figure) of the first carriage 8, that is, on the side to which reflection light from the first mirror 7 is guided. The second carriage 9 is movable in parallel to the original table 4 by means of a drive mechanism (not shown) (e.g. a toothed belt and a DC motor). The second carriage 9 comprises a second mirror 11 for downwardly (in the Figure) deflecting the reflection light from the original which has been guided by the first mirror 7, and a third mirror 12 for deflecting the reflection from the second mirror 11 to the right in the Figure. The second mirror 11 and third mirror 12 are disposed at right angles to each other. The second carriage 9 follows the movement of the first carriage 8 and moves in parallel to the original table 4 at a speed equal to half the speed of the first carriage 8.

A focusing lens 13 for focusing the reflection light from the third mirror 12 at a predetermined magnification is disposed in a plane including an optical axis of the light deflected by the second and third mirrors 11 and 12. A CCD color image sensor (photoelectric conversion element) 15 for converting the reflection light converged by the focusing lens 13 to an electric signal is disposed in a plane substantially perpendicular to the optical axis of the light traveling through the focusing lens 13. An output from the CCD color image sensor 15 is delivered to a main control section 30 (to be described later).

If light from the exposure lamp 5 is converged onto the original placed on the original table 4 by means of the reflector 6, the reflection light from the original is made incident on the color image sensor 15 via the first mirror 7, second mirror 11, third mirror 12 and focusing lens 13. The color image sensor 15 converts the incident light to electric signals of the three primary colors, R (red), G (green) and B (blue).

The color printer section 2 has first to fourth image forming units 10*y*, 10*m*, 10*c* and 10*k* for producing images of four colors, yellow (Y), magenta (M), cyan (C) and black (K), which are color-separated according to a well-known subtractive color mixing process.

A convey mechanism 20 is disposed below the image forming units 10*y*, 10*m*, 10*c* and 10*k*. The convey mechanism 20 includes a convey belt 21 serving as convey means for conveying color images produced by the respective image forming units in a direction indicated by an arrow a. The convey belt 21 is passed between a driving roller 91 rotated by a motor (not shown) in the direction of arrow a and a driven roller 92 disposed apart from the driving roller 91 by a predetermined distance. The convey belt 21 is endlessly run in the direction of arrow a at a fixed speed. The image forming units 10*y*, 10*m*, 10*c* and 10*k* are arranged in tandem in the direction of conveyance of the convey belt 21.

Each of the image forming unit 10*y*, 10*m*, 10*c* and 10*k* includes a photosensitive drum 61*y*, 61*m*, 61*c*, 61*k* serving as an image carrying body. The photosensitive drums 61*y*, 61*m*, 61*c* and 61*k* have outer peripheral surfaces which are rotatable in the same direction at points of contact with the convey belt 21. The photosensitive drums 61*y*, 61*m*, 61*c* and 61*k* are rotated by a motor (not shown) at a predetermined speed.

The photosensitive drums 61*y*, 61*m*, 61*c* and 61*k* are disposed to have their axes arranged at regular intervals from one another and in a direction perpendicular to the direction in which images are conveyed by the convey belt 21. In the description below, assume that the axial direction of each photosensitive drum 61*y*, 61*m*, 61*c*, 61*k* is referred to as a main scan direction (second direction), and the rotational direction of each photosensitive drum 61*y*, 61*m*, 61*c*, 61*k*, that is, the direction of running of the convey belt 21 (the direction of arrow a), is referred to as a sub-scan direction (first direction).

Around each of the photosensitive drum 61*y*, 61*m*, 61*c* and 61*k*, the following elements are disposed in order in the rotational direction: a charging device 62*y*, 62*m*, 62*c*, 62*k* serving as charging means, extended in the main scan direction; a charge erase unit 63*y*, 63*m*, 63*c*, 63*k*; a developing roller 64*y*, 64*m*, 64*c*, 64*k* serving as developing means, similarly extended in the main scan direction; a lower stirring roller 67*y*, 67*m*, 67*c*, 67*k*; an upper stirring roller 68*y*, 68*m*, 68*c*, 68*k*; a transfer device 93*y*, 93*m*, 93*c*, 93*k* serving as transfer means, similarly extended in the main scan direction; a cleaning blade 65*y*, 65*m*, 65*c*, 65*k* similarly extended in the main scan direction; and a waste toner recovering screw 66*y*, 66*m*, 66*c*, 66*k*.

Each transfer device 93*y*, 93*m*, 93*c*, 93*k* is disposed at such a position as to sandwich the convey belt 21 between itself and the photosensitive drum 61*y*, 61*m*, 61*c*, 61*k*, that is, inside the convey belt 21. In addition, an exposure point by an exposure device 50 (to be described later) is formed on that portion of the outer peripheral surface of each photosensitive drum 61*y*, 61*m*, 61*c*, 61*k*, which lies between the charging device 62*y*, 62*m*, 62*c*, 62*k* and the developing roller 64*y*, 64*m*, 64*c*, 64*k*.

Sheet cassettes 22*a*, 22*b* containing paper sheets P as image formation media, on which images formed by the image forming units 10*y*, 10*m*, 10*c*, 10*k* are to be transferred, are disposed below the convey mechanism 20.

A pick-up roller 23*a*, 23*b* is disposed at one end of each of the sheet cassettes 22*a*, 22*b* and on a side close to the driven roller 92. The pick-up roller 23*a*, 23*b* picks up sheets P one by one from the uppermost one from the sheet cassette 22*a*, 22*b*. Register rollers 24 are disposed between the pickup rollers 23*a*, 23*b* and the driven roller 92. The register rollers 24 register and align a leading edge of the sheet P picked up from the sheet cassette 22*a*, 22*b* with a leading edge of a y-toner image formed on the photosensitive drum 61*y* of the image forming unit 10*y*.

Toner images formed on the other photosensitive drums 61*m*, 61*c* and 61*k* are brought to respective transfer positions in accordance with the transfer timing of the sheet P conveyed on the convey belt 21.

An attraction roller 26 for providing an electrostatic attraction force to the sheet P conveyed at the predetermined timing via the register rollers 24 is disposed between the register rollers 24 and the first image forming unit 10*y*, and near the driven roller 92, that is, substantially over the outer peripheral surface of the driven roller 92 with the convey belt 21 interposed. The axis of the attraction roller 26 and the axis of the driven roller 92 are set to be parallel to each other.

A position error sensor 96 for sensing a position of the image formed on the sheet P on the convey belt 21 is disposed in a region at one end of the convey belt 21, and near the driving roller 91, that is, substantially over the outer peripheral surface of the driving roller 91 with the convey belt 21 interposed. The position error sensor 96 comprises, for example, a light transmission type or a light reflection type optical sensor.

A convey belt cleaning device 95 for removing toner adhering to the convey belt 21 or paper dust of the sheet P is disposed at the outer peripheral surface of the driving roller 91, in contact with the convey belt 21 on the downstream side of the position error sensor 96.

A fixing device 80 is disposed in a region to which the sheet P conveyed by the convey belt 21 and separated from the driving roller 91 is delivered. The fixing device 80 heats the sheet P at a predetermined temperature, fuses the toner image transferred on the sheet P, and fixes the toner image on the sheet P. The fixing device 80 comprises a heat roller pair 81, oil apply rollers 82 and 83, a web winding roller 84, a web roller 85, and a web press roller 86. The toner on the sheet P is fixed and the sheet P with the fixed toner image is discharged by a discharge roller pair 87.

The exposure device 50 forms color-separated electrostatic latent images on outer peripheral surfaces of the respective photosensitive drums 61*y*, 61*m*, 61*c* and 61*k*. The exposure device 50 has a semiconductor laser 60. The light emission from the semiconductor laser 60 is controlled on the basis of image data (y, m, c, k) of respective colors separated by an image processing apparatus 36 (to be described below). A polygon mirror 51 rotated by a polygon motor 54 to reflect and scan laser beams and fθ lenses 52 and 53 for focusing the laser beams reflected by the polygon mirror 51 by correcting their focal points are disposed in the named order along the optical path of the semiconductor laser 60.

First deflection mirrors 55*y*, 55*m*, 55*c* and 55*k* for deflecting the respective color laser beams emanating from the fθ lens 53 toward the exposure points on the photosensitive drums 61*y*, 61*m*, 61*c* and 61*k*, and second and third deflection mirrors 56*y*, 56*m*, 56*c*, 57*y*, 57*m* and 57*c* for further deflecting the laser beams deflected by the first deflection mirrors 55*y*, 55*m* and 55*c* are disposed between the fθ lens 53 and the photosensitive drums 61*y*, 61*m*, 61*c* and 61*k*.

The laser beam for black is deflected by the first deflection mirror 55*k* and then directly guided to the photosensitive drum 61*k* without intervention of other mirrors.

Figure 2:
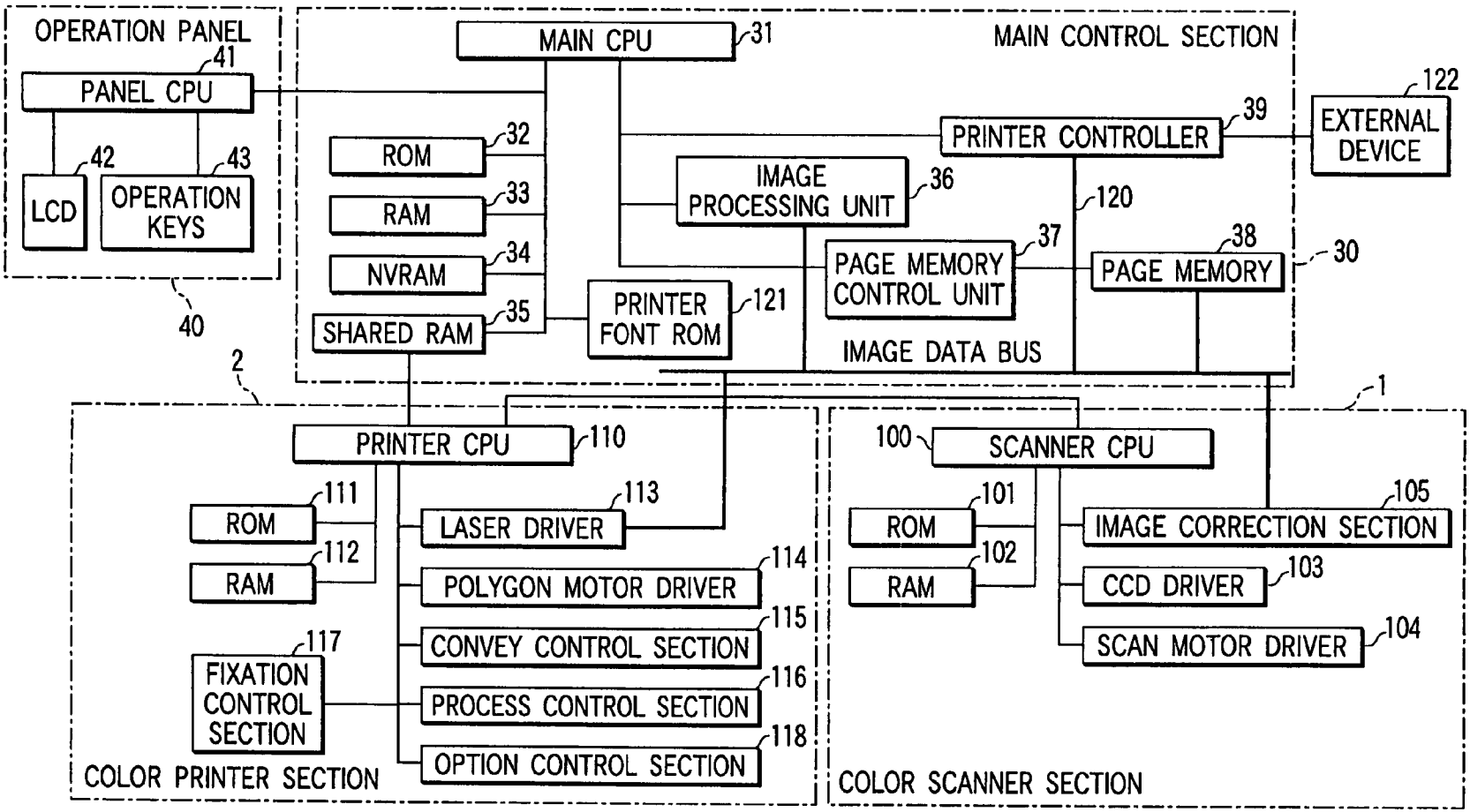
FIG. 2 is a block diagram schematically showing the structure of the tandem-drum type color image forming apparatus.

FIG. 2 is a block diagram schematically showing electrical connection of the digital copying machine shown in FIG. 1 and flow of signals for control. In FIG. 2, a control system comprises three CPUs (Central Processing Units): a main CPU 31 provided in a main control section 30; a scanner CPU 100 in the color scanner section 1; and a color printer CPU 110 in the color printer section 2.

The main CPU 31 performs bi-directional communication with the printer CPU 110 via a shared RAM (Random Access Memory) 35. The main CPU 31 issues an operational instruction, and the printer CPU 110 returns status data. Serial communication is performed between the printer CPU 110 and scanner CPU 100. The printer CPU 110 issues an operational instruction, and the scanner CPU 100 returns status data.

An operation panel 40 comprises a liquid crystal display (LCD) 42, various operation keys 43, and a panel CPU 41 to which these are connected. The operation panel 40 is connected to the main CPU 31.

The main control section 30 comprises the main CPU 31, a ROM (Read-Only Memory) 32, a RAM 33, an NVRAM 34, shared RAM 35, image processing unit 36, a page memory control unit 37, a page memory 38, a printer controller 39, and a printer font ROM 121.

The main CPU 31 controls the entirety of the main control section 30. The ROM 32 stores, e.g. control programs and firmware for setting various data in an internal register (to be described later). The RAM 33 temporarily stores data.

The NVRAM (Non-Volatile RAM) 34 is a non-volatile memory backed up by a battery (not shown), and even when power is not supplied, stored data is maintained.

The shared RAM 35 is used to perform bi-directional communication between the main CPU 31 and printer CPU 110.

The page memory control unit 37 stores and read out image information in and from the page memory 38. The page memory 38 has areas capable of storing image information of a plurality of pages. The page memory 38 can store compressed data in units of a page, which is obtained by compressing image information from the color scanner section 1.

The printer font ROM 121 stores font data corresponding to print data. The printer controller 39 develops print data, which is sent from an external device 122 such as a personal computer, into image data using the font data stored in the printer font ROM 121 with a resolution corresponding to resolution data added to the print data.

The color scanner section 1 comprises the scanner CPU 100 for controlling the entirety of the color scanner section 1; a ROM 101 storing control programs, etc.; a data storage RAM 102; a CCD driver 103 for driving the color image sensor 15; a scan motor driver 104 for controlling the rotation of a scan motor for moving the first carriage 8, etc.; and an image correction section 105.

The image correction section 105 comprises an A/D converter for converting RGB analog signals output from the color image sensor 15 to digital signals; a shading correction circuit for correcting a variance in the color image sensor 15 or a variation in threshold level due to ambient temperature variation relative to the output signal from the color image sensor 15; and a line memory for temporarily storing shading-corrected digital signals from the shading correction circuit.

The color printer section 2 comprises the printer CPU 110 for controlling the entirety of the color printer section 2; a ROM 111 storing control programs, etc.; a data storage RAM 112; a laser driver 113 for driving the semiconductor laser 60; a polygon motor driver 114 for driving the polygon motor 54 of the exposure device 50; a convey control section 115 for controlling conveyance of the sheet P by the convey mechanism 20; a process control section 116 for controlling charging, developing and transferring processes using the charging device, developing roller and transfer device; a fixation control section 117 for controlling the fixing device 80; and an option control section 118 for control options.

The image processing unit 36, page memory 38, printer controller 39, image correction section 105 and laser driver 113 are connected over an image data bus 120.

The controls according to the present invention will now be described.

The printer CPU 110 activates the convey control section 115 to control the rotations of the respective-color photosensitive drums 61*k*, 61*c*, 61*m* and 61*y* and the driving of the convey belt 21. In the description below, the photosensitive drum 61*k* is referred to as "black drum", and the photosensitive drums 61*c*, 61*m* and 61*y* are referred to as "color drums".

The pitch of images varies cyclically due to, e.g. eccentricity of the drums, run-out of drum driving shafts, and eccentricity of drum driving gears. In the case of a tandem-drum type color image forming apparatus, if the phase of a pitch variation cycle is uniform among respective colors, the amount of color registration error, or color misregistration, is small. However, if there is a phase error, the amount of color misregistration becomes conspicuous and cyclically varies.

Figure 3:
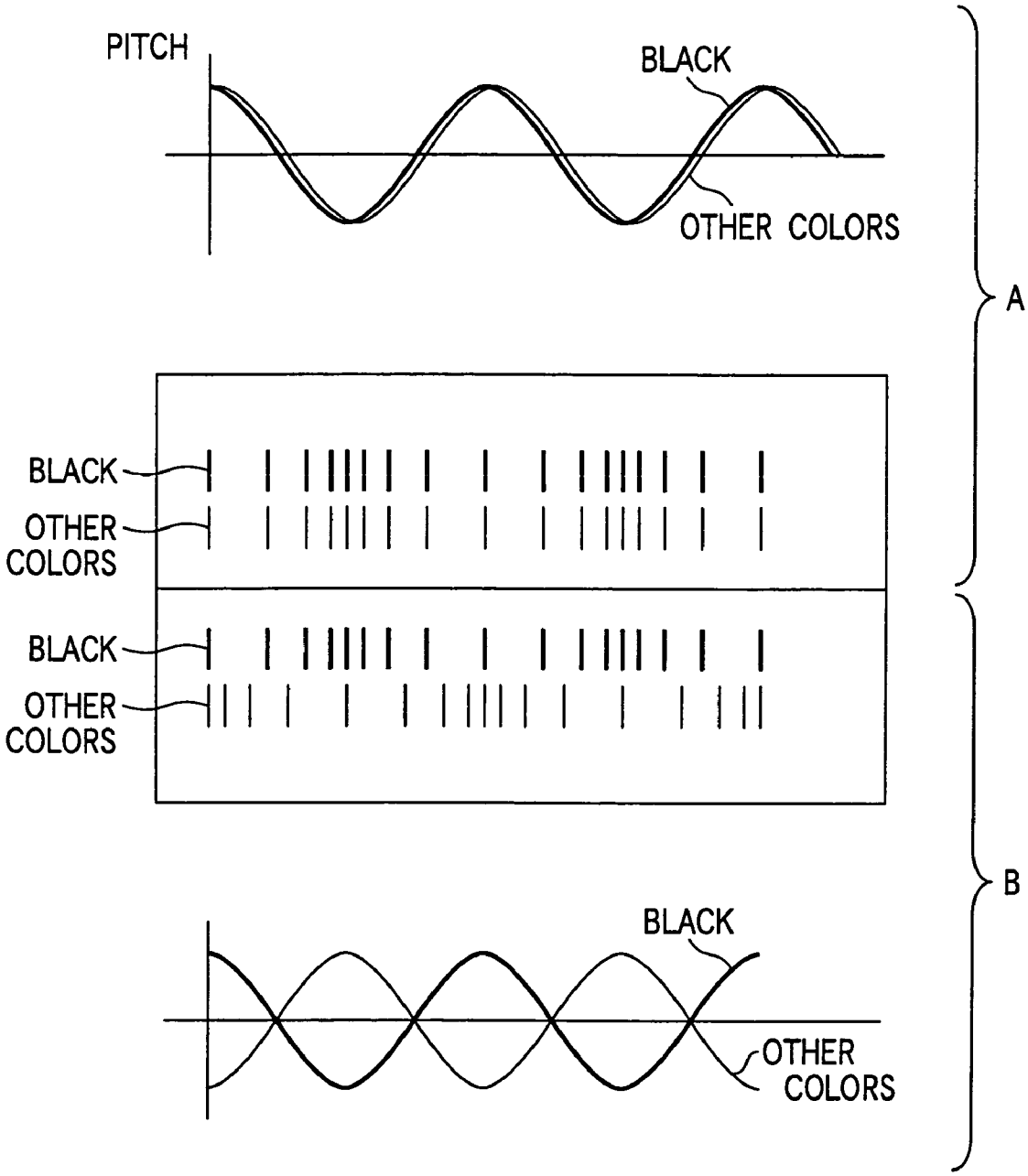
FIG. 3 is a view for explaining a color misregistration between black and other colors.

FIG. 3 shows color misregistration between black and other colors. Portion A in FIG. 3 shows a state in which a phase angle difference between black and other colors is minimum and thus a color misregistration is minimum. Portion B of FIG. 3 shows a state in which a phase angle difference between black and other colors shifts by 180° from the phase angle difference at which the color misregistration is minimum.

The tandem-drum type color image forming apparatus of the present invention has a color mode and a black mode. In the color mode, the photosensitive drums 61*k*, 61*c*, 61*m* and 61*y* of the respective colors are rotated. In the black mode, only the black drum is rotated, and the color drums are stopped. Thus, when the black mode is switched to the color mode, a phase angle difference between the black drum and the color drums varies depending on the time during which only the black drum is rotated in the black mode. Consequently, the degree of color misregistration varies before and after the black mode.

To cope with this problem, the printer CPU 110 in the present invention activates the convey control section 115 to control the rotations of the black drum (photosensitive drum 61*k*) and color drums (photosensitive drums 61*c*, 61*m* and 61*y*) as follows.

FIGS. 4 to 8 show the relationship between the rotational speed of the black drum and color drums and the time when the operation mode is changed in the order of "color mode⟹black mode⟹color mode". In this example, image formation in each mode is performed in units of a page, but the mode may be switched during the image formation on one page.

(1) The printer CPU 110 controls the rotations of the black drum and color drums so that the phase angle difference between the black drum and color drums during the image formation in the color mode may not vary before and after the execution of the black mode.

Figure 4:
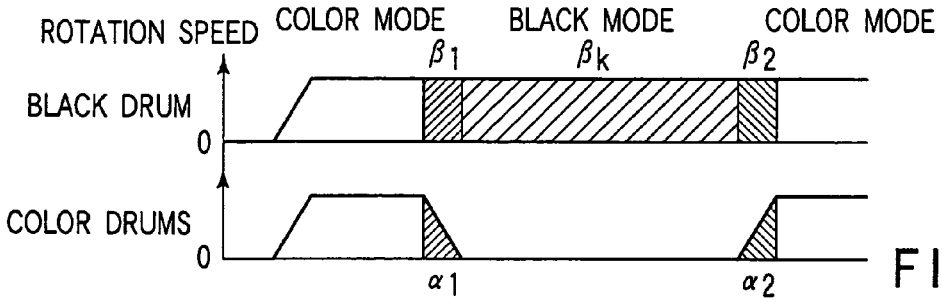
FIG. 4 shows the number of revolutions of a black drum and color drums at the time of mode shift.

FIG. 4 illustrates a case where the operation mode is shifted in the order of "color mode⟹black mode⟹color mode" while the black drum is kept rotating. In this case, the printer CPU 110 controls the rotations of the black drum and color drums so as to meet the following condition:

$$\beta 1+\beta k+\beta 2-\alpha 1-\alpha 2=2\pi n(\beta k\geqq 0,\ n=\text{a positive integer})$$

where $\alpha 1$ is a phase angle by which the color drums progress from the start of deceleration to the stop of motion, $\beta 1$ is a phase angle by which the black drum progresses during the same time period, $\beta k$ is a phase angle by which the black drum progresses while the color drums are stopped (i.e. rotational angle needed in black mode+correction of phase angle), $\alpha 2$ is a phase angle by which the color drums progress from the start of rotation to the end of acceleration, and $\beta 2$ is a phase angle by which the black drum progresses during the same time period.

Figure 5:
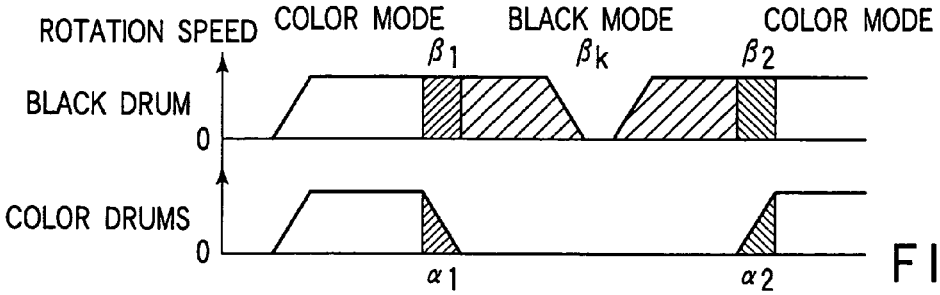
FIG. 5 shows the number of revolutions of the black drum and color drums at the time of mode shift.

FIG. 5 illustrates a case where the black drum is temporarily stopped in the black mode while the operation mode is shifted in the order of "color mode⟹black mode⟹color mode" as shown in FIG. 4. During the stop, the phase angle of the black drum is unchanged. Thus, the same control as in FIG. 4 is performed.

(2) The printer CPU 110 controls the rotations of the black drum and color drums so that the phase angle difference between the respective drums remains the same while the drums are stopped both in the color mode and the black mode. Assume that a phase angle, by which the black drum progresses from the start of deceleration to the stop of motion, is $\gamma 1$, and a phase angle, by which the black drum progresses from the start of rotation to the end of acceleration, is $\gamma 2$.

Figure 6:
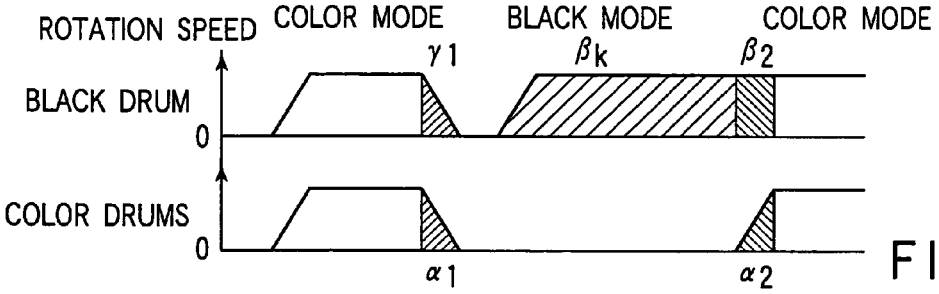
FIG. 6 shows the number of revolutions of the black drum and color drums at the time of mode shift.

(a) In a case, as shown in FIG. 6, where the black drum and color drums temporarily stop when the color mode is switched to the black mode, and then the rotation of the black drum is started in the black mode and the black mode is switched to the color mode while the black drum is kept rotating, the printer CPU 110 controls the rotations of the black drum and color drums so as to meet the following conditions:

$$\gamma 1=\alpha 1,\ \text{and}$$

$$\beta k+\beta 2-\alpha 2=2\pi n(\beta k\geqq 0,\ n=\text{a positive integer}).$$

Figure 7:
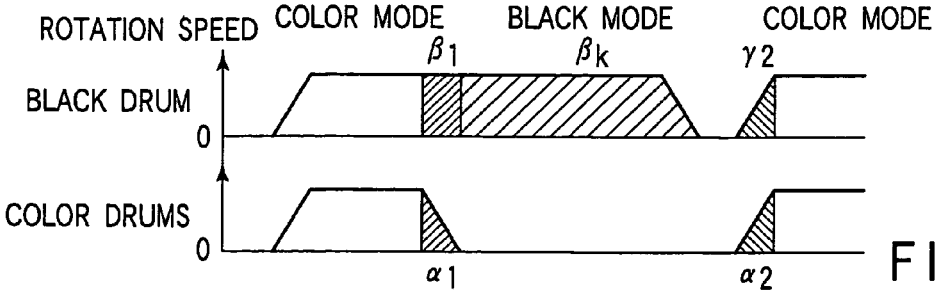
FIG. 7 shows the number of revolutions of the black drum and color drums at the time of mode shift.

(b) In a case, as shown in FIG. 7, where the color mode is switched to the black mode while the black drum is kept rotating, and then the black drum is stopped in the black mode, following which the rotations of the black drum and color drums are started in the subsequent color mode, the printer CPU 110 controls the rotations of the black drum and color drums so as to meet the following conditions:

$\gamma 2=\alpha 2$, and $\beta 1+\beta k-\alpha 1=2\pi n(\beta k\geqq 0,\ n=\text{a positive integer})$.

Figure 8:
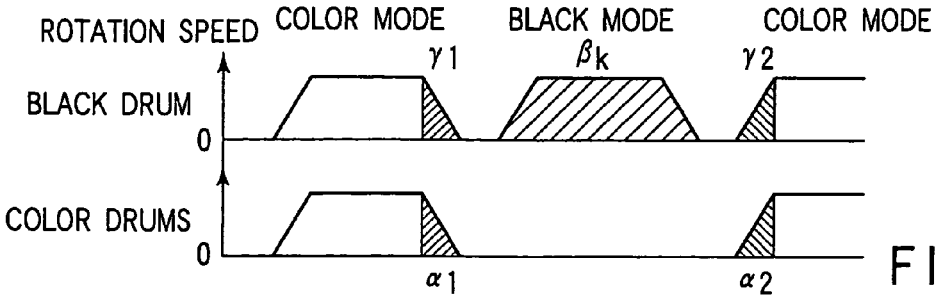
FIG. 8 shows the number of revolutions of the black drum and color drums at the time of mode shift.

(c) In a case, as shown in FIG. 8, where all the drums are stopped when the color mode is switched to the black mode and when the black mode is switched to the color mode, the printer CPU 110 controls the rotations of the black drum and color drums so as to meet the following conditions:

$\gamma 1=\alpha 1$, $\gamma 2=\alpha 2$, and $\beta k=2\pi n(\beta k\geqq 0,\ n=\text{a positive integer})$.

(3) In the above controls (2) and (3), the printer CPU 110 controls the acceleration curve and deceleration curve in the same manner for the black drum and color drums, and the printer CPU 110 equalizes the rotation start timing and deceleration start timing in the color mode for the black drum and color drums.

(4) In the present embodiment, in order to realize the controls (1), (2) and (3), stepping motors are used as driving sources for driving the black drum and color drums. The stepping motor is rotated by a predetermined angle in accordance with a drive pulse. Thus, the stepping motor can be rotated by only a necessary angle by a drive pulse generated from the printer CPU 110. The phase angle control in the present invention can be realized by managing the number of drive steps of each stepping motor. The stepping motor may be replaced with an ultrasonic motor.

(5) With the controls (1) to (4) as described above, the drum phase angle difference can be set at a value at which color misregistration is minimized.

(6) The phase angle difference may be set at the time of assembly of the apparatus on the basis of eccentricity of gears, run-out of shafts, etc. In addition, the phase angle difference may be set on the basis of a result of checking of an output image or an image on the transfer belt 21.

(7) Furthermore, a motor may be provided for each of the drums. Alternatively, one motor may be provided for the black drum, and another motor may be provided for the color drums. When the color drums are driven by a single motor, a load on the motor is greater than the load on the motor that drives the black drum and so the acceleration curve and deceleration curve of the color drums may be made gentler than those of the black drum. However, this is not applicable to the control (3).

As has been described above, according to the embodiment of the present invention, it is possible to prevent a variation (degradation) of color misregistration before and after the black mode, and to maintain a state in which a color registration error is small.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming method that forms an image using a photosensitive drum for black and photosensitive drums for colors other than black, on which electrostatic latent images are formed, wherein there are provided a black mode in which only the photosensitive drum for black is rotated and a color mode in which all the photosensitive drums are rotated, and rotations of the photosensitive drum for black and the photosensitive drums for the other colors are controlled such that a phase angle difference between the photosensitive drum for black and the photosensitive drums for the other colors after image formation in the color mode is unchanged before and after execution of the black mode.

2. The image forming method according to claim 1, wherein drive means for driving the photosensitive drum for black and the photosensitive drums for the other colors is a stepping motor.

3. The image forming method according to claim 1, wherein drive means for driving the photosensitive drum for black and the photosensitive drums for the other colors is an ultrasonic motor.

4. The image forming method according to claim 1, wherein rotation of a motor that drives the photosensitive drum for black and rotation of a motor that drives the photosensitive drums for the other colors are controlled.

5. The image forming method according to claim 1, wherein rotation of a motor that drives the photosensitive drum for black and rotation of a plurality of motors that drive the photosensitive drums for the other colors are controlled.

6. The image forming method according to claim 1, wherein when the color mode is switched to the black mode and when the black mode is switched to the color mode, the rotations of the photosensitive drum for black and the photosensitive drums for the other colors are controlled to meet the following condition:

$\beta 1+\beta k+\beta 2-\alpha 1-\alpha 2=2\pi n(\beta k\geqq 0,\ n=\text{a positive integer})$ where $\alpha 1$ is a phase angle by which the photosensitive drums for the other colors progress from a start of deceleration to a stop of motion, $\beta 1$ is a phase angle by which the photosensitive drum for black progresses during the same time period, $\beta k$ is a phase angle by which the photosensitive drum for black progresses while the photosensitive drums for the other colors are stopped, $\alpha 2$ is a phase angle by which the photosensitive drums for the other colors progress from a start of rotation to an end of acceleration, and $\beta 2$ is a phase angle by which the photosensitive drum for black progresses during the same time period.

7. The image forming method according to claim 1, wherein a stop time period in which the photosensitive drum for black is stopped is provided during execution of the black mode.

8. An image forming method that forms an image using a photosensitive drum for black and photosensitive drums for colors other than black, on which electrostatic latent images are formed, wherein in both a black mode in which only the photosensitive drum for black is rotated and a color mode in which all the photosensitive drums are rotated, rotations of the photosensitive drum for black and the photosensitive drums for the other colors are controlled such that a phase angle difference between the photosensitive drums is made to remain the same at a time when the rotation of the photosensitive drum for black or the rotation of the photosensitive drums for the other colors is stopped.

9. The image forming method according to claim 8, wherein a condition, $\gamma 1=\alpha 1$, is satisfied in a case where all the photosensitive drums are stopped when the color mode is switched to the black mode, and a condition, $\gamma 2=\alpha 2$, is satisfied in a case where rotation of all the photosensitive drums is started when the black mode is switched to the color mode, where $\alpha 1$ is a phase angle by which the photosensitive drums for the other colors progress from a start of deceleration to a stop of motion, $\beta 1$ is a phase angle by which the photosensitive drum for black progresses during the same time period, $\beta k$ is a phase angle by which the photosensitive drum for black progresses while the photosensitive drums for the other colors are stopped, $\alpha 2$ is a phase angle by which the photosensitive drums for the other colors progress from a start of rotation to an end of acceleration, $\gamma 1$ is a phase angle by which the photosensitive drum for black progresses during the same time period, and $\gamma 2$ is a phase angle by which the photosensitive drum for black progresses from a start of rotation to an end of acceleration.

10. The image forming method according to claim 9, wherein in a case where the color mode is switched to the black mode while the photosensitive drum for black is kept rotating, and then the photosensitive drum for black is stopped in the black mode, a control is effected to meet the following condition:

$$\beta 1+\beta k-\alpha 1=2\pi n(\beta k\geqq 0,\ n=\text{a positive integer}).$$

11. The image forming method according to claim 9, wherein in a case where rotation of the photosensitive drum for black is started in the black mode and the black mode is switched to the color mode while the photosensitive drum for black is kept rotating, a control is effected to meet the following condition:

$$\beta k+\beta 2-\alpha 2=2\pi n(\beta k\geqq 0,\ n=\text{a positive integer}).$$

12. The image forming method according to claim 9, wherein in a case where rotation of all the photosensitive drums is stopped when the color mode is switched to the black mode and when the black mode is switched to the color mode, a control is effected to meet the following condition:

$$\beta k=2\pi n(\beta k\geqq 0,\ n=\text{a positive integer}).$$

13. The image forming method according to claim 8, wherein an acceleration curve and a deceleration curve are controlled in the same manner for the photosensitive drum for black drum and the photosensitive drums for the other colors, and a control is effected to equalize a rotation start timing and a deceleration start timing in the color mode for the photosensitive drum for black and the photosensitive drums for the other colors.

* * * * *